US005558614A

United States Patent [19]

Anderson et al.

[11] Patent Number: 5,558,614

[45] Date of Patent: Sep. 24, 1996

[54] TUBULAR CARTON OPENING, PRESENTING, AND CLOSING APPARATUS

[75] Inventors: David L. Anderson; Irvan L. Pazdernik, both of Alexandria, Minn.

[73] Assignee: Douglas Machine Limited Liability Company, Alexandria, Minn.

[21] Appl. No.: 198,060

[22] Filed: Feb. 18, 1994

Related U.S. Application Data

[63] Continuation-in-part of Ser. No. 89,042, Jul. 9, 1993, Pat. No. 5,352,178, which is a continuation-in-part of Ser. No. 17,480, Feb. 12, 1993, Pat. No. 5,445,590.

[51] Int. Cl.[6] ..... B31B 49/00

[52] U.S. Cl. ..... 493/312; 493/313

[58] Field of Search ..... 53/468, 491, 492, 53/249, 250, 377.3, 377.5, 382.1, 382.2, 382.3; 493/309, 310, 312, 313, 141, 142

[56] References Cited

U.S. PATENT DOCUMENTS

| | | | |
|---|---|---|---|
| 1,058,522 | 4/1913 | Auchu | 493/308 |
| 1,123,976 | 1/1915 | Auchu | 493/308 |
| 2,510,343 | 6/1950 | Krause | 53/382.1 |
| 2,871,641 | 2/1959 | Tobey | 53/382.1 |
| 2,989,903 | 6/1961 | Wilcox . | |
| 3,323,283 | 6/1967 | Johnson, Jr. et al. | 53/566 |
| 3,452,653 | 7/1969 | Berney | 53/38203 |
| 4,061,081 | 12/1977 | Pinto et al. | 493/317 |
| 4,514,956 | 5/1985 | Varallo . | |
| 4,567,712 | 2/1986 | Varallo | 53/381 R |
| 4,570,421 | 2/1986 | Focke | 53/491 |
| 4,596,543 | 6/1986 | Reiser | 493/141 |
| 4,854,930 | 8/1989 | Miselli et al. | 493/317 |
| 4,917,229 | 4/1990 | Korkowski . | |
| 5,102,382 | 4/1992 | Center | 493/183 |
| 5,102,385 | 4/1992 | Calvert | 493/317 |
| 5,106,359 | 4/1992 | Lott | 493/151 |
| 5,131,208 | 7/1992 | Paul | 493/141 |
| 5,207,630 | 5/1993 | Decker et al. | 493/317 |
| 5,429,580 | 7/1995 | Diaz | 493/374 |

FOREIGN PATENT DOCUMENTS 2564422 11/1985 France .

*Primary Examiner*—Jack W. Lavinder
*Attorney, Agent, or Firm*—Peterson, Wicks, Nemer & Kamrath, P.A.

[57] ABSTRACT

Apparatus (200) for opening the closure flaps (22–25) of a carton (12), for presenting the carton (12) for loading, and for closing the closure flaps (22–25) is disclosed including a carrier (202) which initially receives the carton (12). The carrier (202) carries the carton (12) into a carriage (226), with the carton (12) sandwiched therebetween. The closure flaps (22–25) are opened by a device (242) including fingers (254–257) which are pivoted to an expanded position after their insertion through an opening (27) in the closure flaps (22–25). An elevator (212) raises the carton (12) in the carriage (226) while the carton (12) is still under compression, with suction cups (56,171–173) then being attached to the closure flaps (22–25). The carriage (226) can then be moved to a loading position and back where the closure flaps (22–25) of the loaded carton (12) are fan folded by a device (120). The elevator (212) can then be lowered where the closed carton (12) can be pushed therefrom.

24 Claims, 5 Drawing Sheets

TUBULAR CARTON OPENING, PRESENTING, AND CLOSING APPARATUS

CROSS REFERENCE

The present application is a continuation-in-part of application Ser. No. 08/089,042 filed on Jul. 9, 1993, now U.S. Pat. No. 5,352,178, which is a continuation-in-part of application Ser. No. 08/017,480 filed on Feb. 12, 1993, now U.S. Pat. No. 5,445,590.

BACKGROUND

The present invention generally relates to apparatus for opening the tops of erected cartons, presenting the opened carton for loading, and/or closing the loaded carton, particularly to apparatus for closing the loaded cartons of the tubular type by fan folding the closure flaps, and specifically to apparatus for handling tubular cartons which have been previously utilized or which have not been previously utilized.

Many types of products are stored and transported in cartons which hold multiple products. Once reaching their final destination, the products are removed from the carton such as for their retail sale, and the carton is disposed of. Although previously such used cartons were simply disposed of as waste, with increasing ecological and environmental awareness, such used cartons are often recycled. However, to further enhance the reduction of waste, it has become desirable for the cartons to be reused multiple times (such as on the average of eight times) before they are recycled or otherwise disposed of. It can then be appreciated that with the product removed, it is then desired that the carton be stored and transported in a flat or collapsed condition for space reduction to the factory or similar location where the carton is again erected or set up for reuse by again filling the carton with product.

Various types of packaging machines exist for opening, loading, and/or closing cartons. However, most existing packaging machines were designed to handle cartons which have not been previously utilized and which have not been previously erected or set up. Cartons which have been previously used and then returned to their flat or collapsed condition for reuse are not as rigid as new cartons and are more difficult to automatically, mechanically handle. Thus, many prior packaging machines had difficulty handling used cartons. This difficulty is further complicated as cartons at various stages of their lives from being new to being reused their first or second time to being reused their last time and thus of varying degrees of rigidity and ease of handling are intermixed in their collapsed condition in the carton magazine or hopper of the packaging machines.

Additionally, it is desired that the reuse of cartons be as competitive as possible with utilizing only new cartons in packaging in addition to the ecological advantages gained by reuse. Towards that end, it is desired that handling of the reused carton be made as minimal and as easy as possible.

Thus a need exists for apparatus for mechanically handling cartons and specifically which is able to handle without difficulty intermixed cartons at various stages of their lives and which allows ease and minimization of handling reused cartons.

SUMMARY

The present invention solves this need and other problems in the field of packaging machines for handling cartons by providing, in the most preferred form, a method and apparatus for uniformly positioning the carton into a carriage wherein the carton is placed in the carriage under compression within the carriage such as by a movable carrier in the preferred form and then the carton is pushed such as by a movable elevator in the preferred form while the carton is under compression in the carriage. In the most preferred form, the carton is attached by suction cups of the carriage after the carton is pushed by the elevator.

In a further aspect of the present invention, the top of the carton is opened by inserting a plurality of fingers through an opening defined by the free edges of the closure flaps of the top while in an insertion position and then expanding the fingers to a size larger than the top opening. In the most preferred form, the fingers are pivotally mounted to a reciprocal plate and are pivoted relative to the plate between their insertion and expanded positions.

In the preferred form of the present invention, the carton is attached by suction cups after being positioned in the carriage, with the carriage then moving to a loading position and back where the top closure flaps of the loaded carton are then fan folded to a closed position, with the closed carton being removed from the carriage by the elevator returning to its first position.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
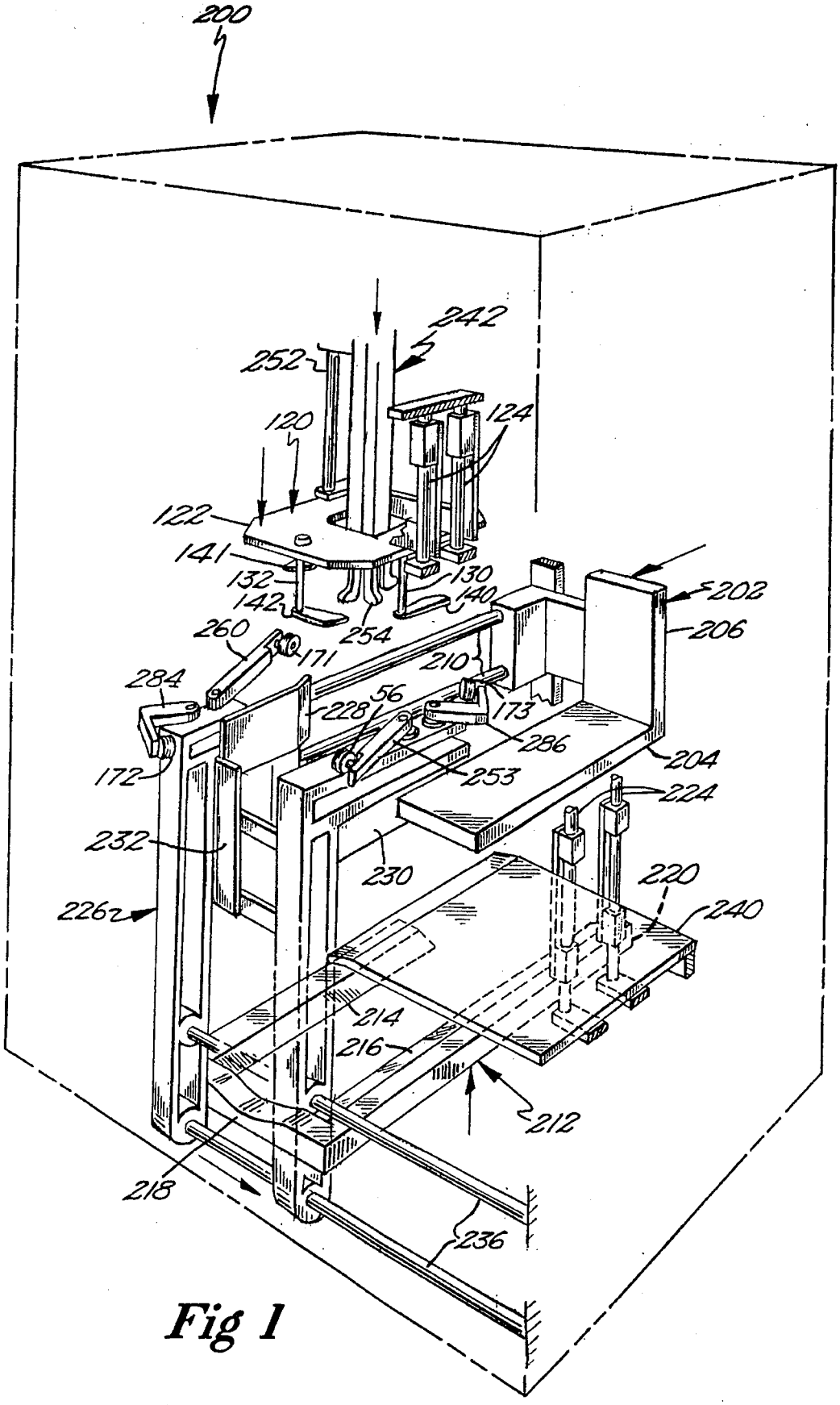
FIG. 1 shows a partial, perspective view of an apparatus for handling tubular cartons according to the preferred teachings of the present invention, with portions shown in phantom to show constructional details.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "front", "back", "rear", "upper", "lower", "height", "width", "end", "side", "horizontal", "vertical", and similar terms are used herein, it should be understood that these terms have reference only to the structure shown in the drawings as it would appear to a person viewing the drawings and are utilized only to facilitate describing the invention.

DESCRIPTION

Apparatus for handling cartons according to the preferred teachings of the present invention is shown in the drawings and generally designated 200. Although apparatus 200 and the carton handling methods performed thereby may be utilized with cartons of various configurations, apparatus 200 is designed primarily for opening cartons 12 of the type illustrated in the drawings. Such cartons 12 generally comprise a plurality of body walls, such as side panels 14 and 16 and end panels 18 and 20 which are hingedly connected together along hinge connections into an annularly continuous tubular configuration in any suitable manner. Such body walls may have any suitable dimensional relationship, but in the embodiment illustrated, side panels 14 and 16 are of a width somewhat greater than the width of end panels 18 and 20. All of such walls have equal length, however.

Hingedly connected to carton 12 at opposite ends thereof are carton closure means in the form of opposite cooperable pairs of closure flaps 22–25 which are intended to seal the top and bottom of carton 12. Corresponding flaps 22–25 at opposite ends of carton 12 generally are identical. Particularly, hingedly connected to the margin of each of side panels 14 and 16 are upper and lower major closure flaps 22 and 23, respectively. A pair of minor end closure side flaps 24 and 25 are hingedly connected to margins of opposite end panels 18 and 20, respectively.

Flaps 22–25 in the most preferred form have lengths from their outer free edges to their hinged connections to panels 14, 16, 18, and 20 which are equal in the most preferred form. The lengths of minor flaps 24 and 25 are substantially less than the width of panels 14 and 16 and major flaps 22 and 23 so that the outer free edges of flaps 22 and 23 extend longitudinally of carton 12 beyond the outer free edges of minor flaps 24 and 25. In the most preferred form, the lengths of flaps 22 and 23 are each less than one-half the widths of panels 18 and 20 and flaps 24 and 25. Thus, an opening 27 is defined in the top and bottom of carton 12 between the outer free edges of flaps 22–25.

Figure 3:
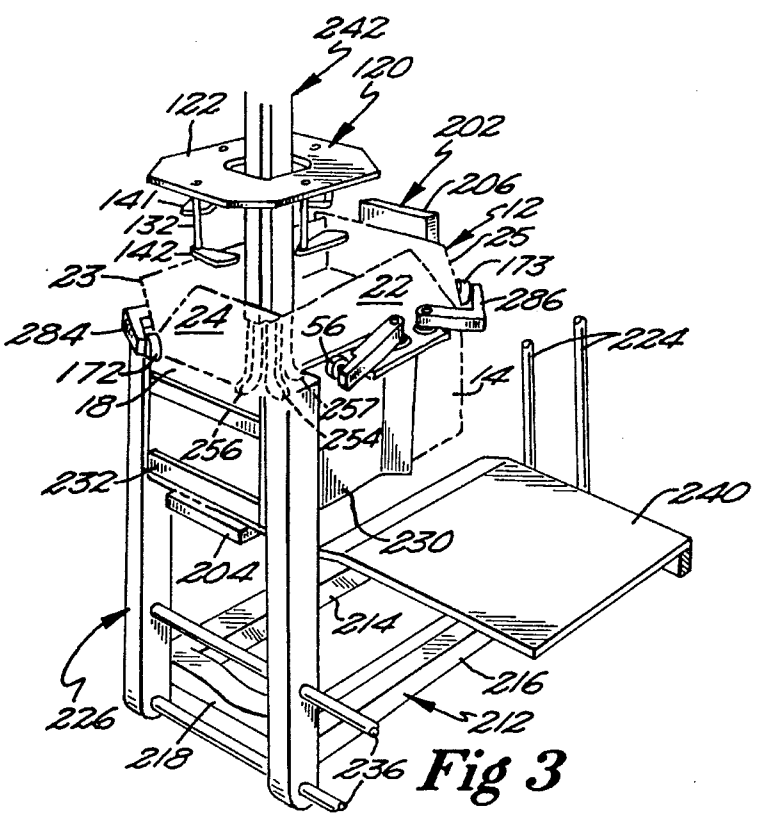
FIGS. 2–7 show diagrammatic, perspective views of the operating positions of the apparatus of FIG. 1.
Figure 5:
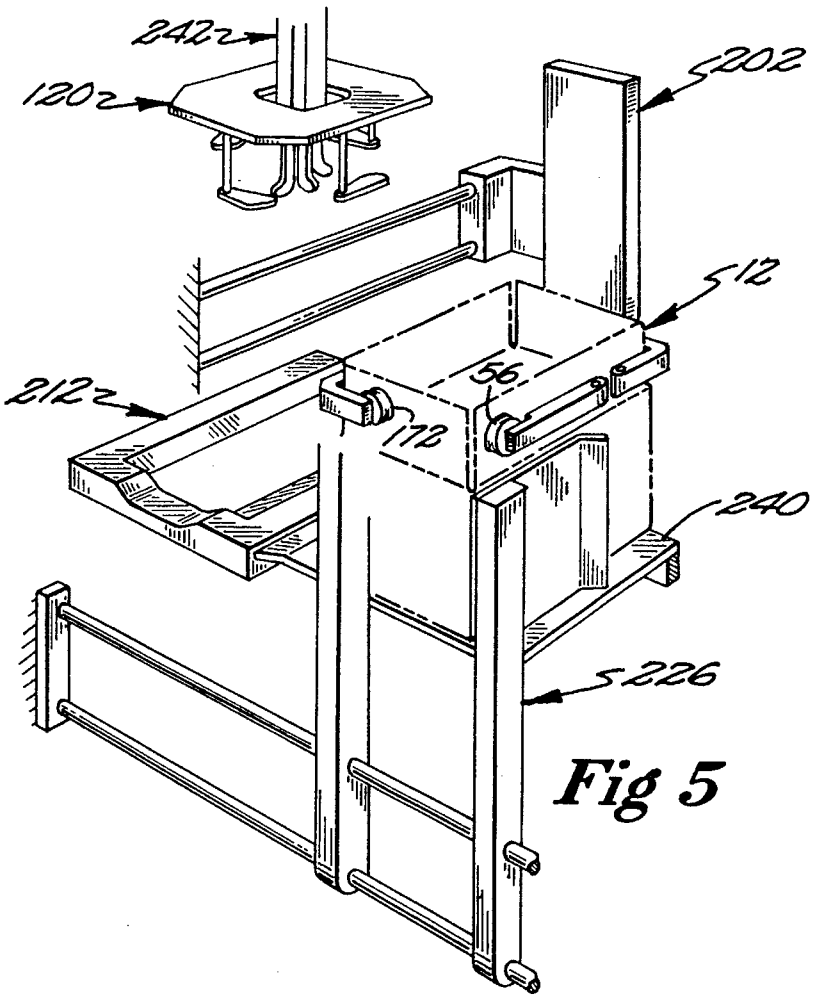
Figure 4:
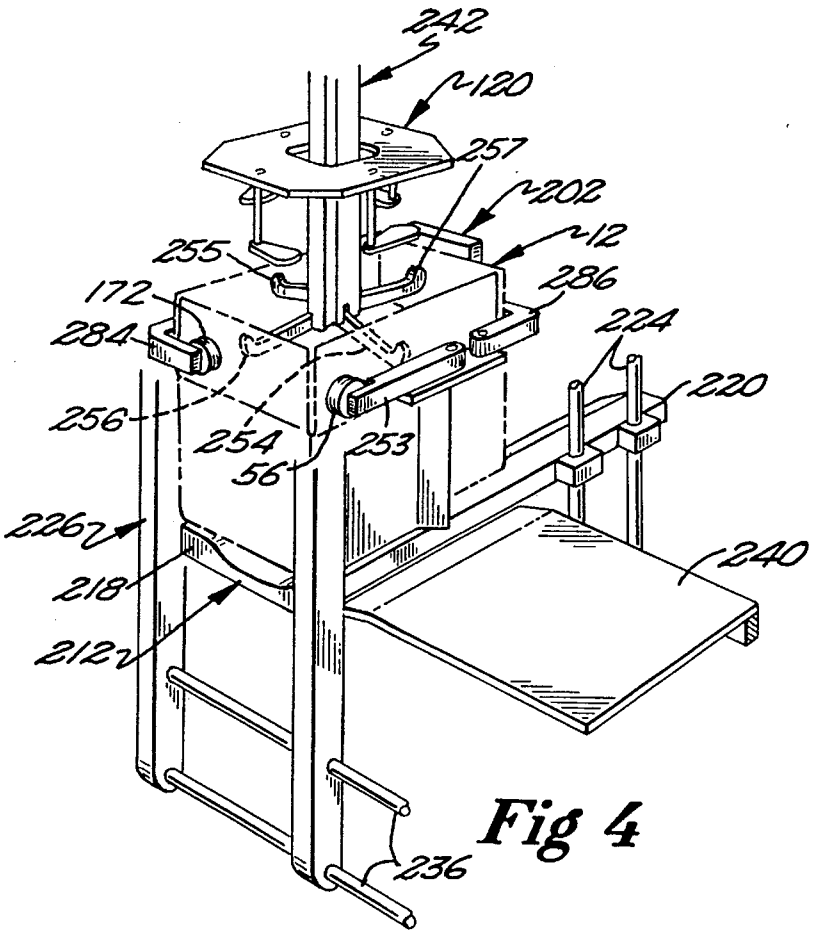
Figure 7:
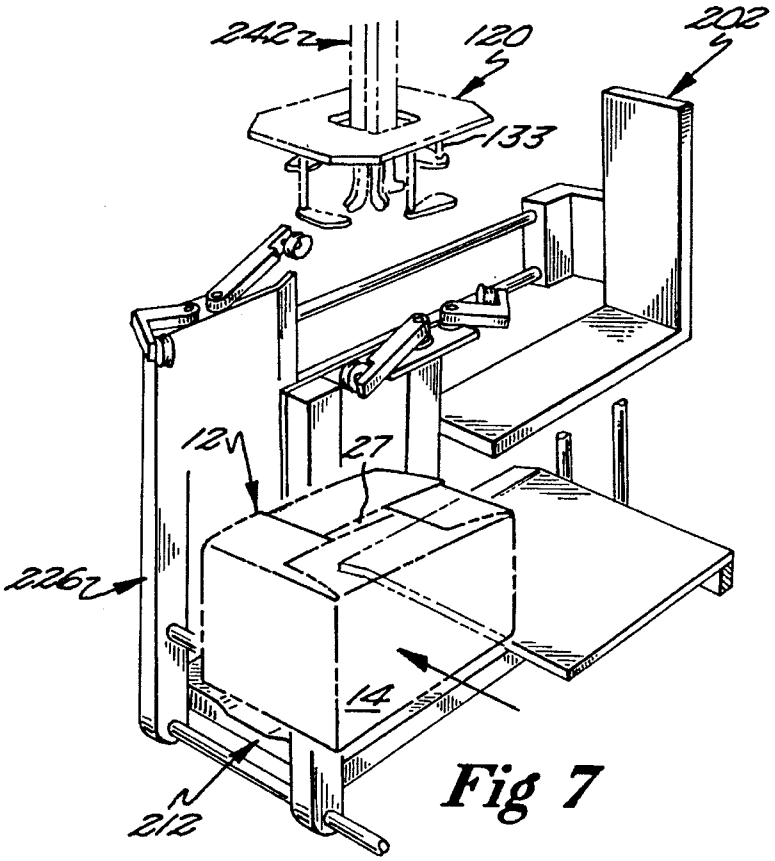
Figure 6:
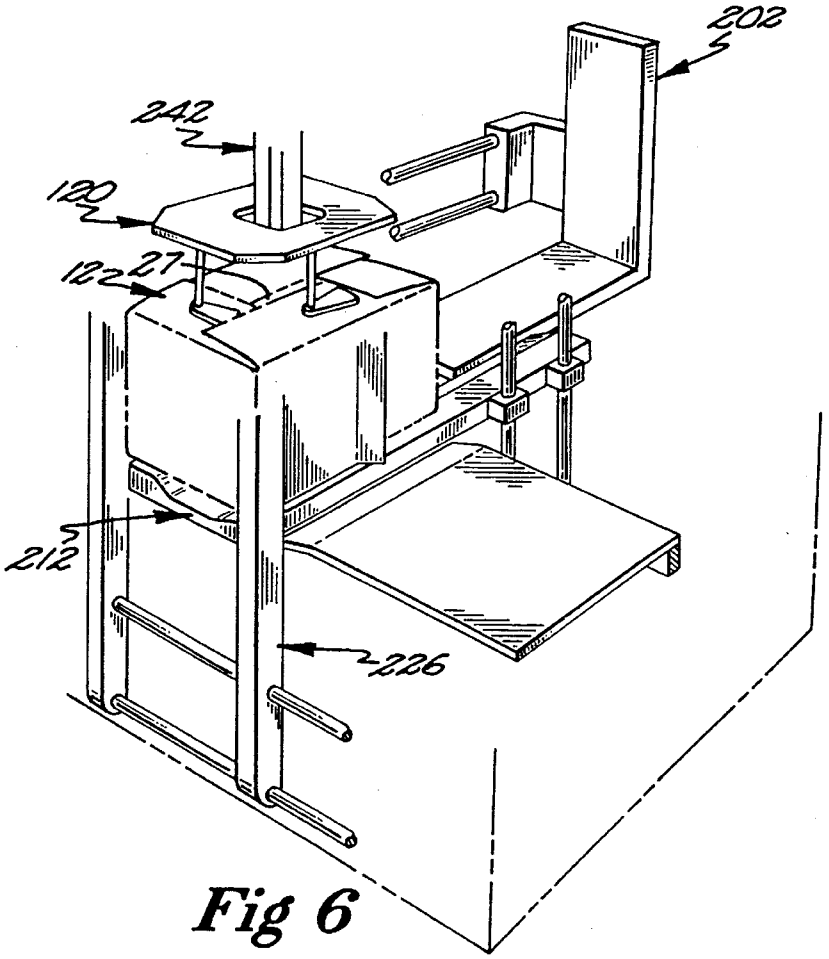
Figure 8:
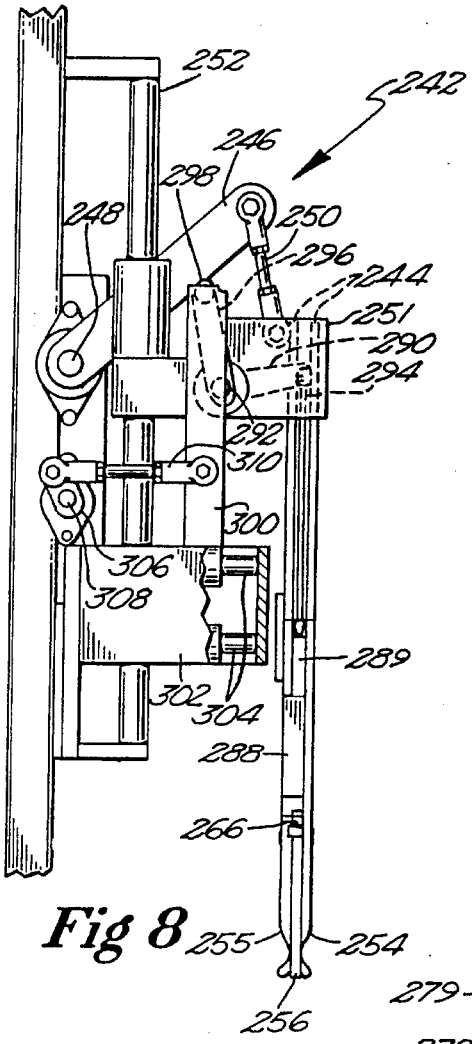
FIG. 8 shows a side view of the top opening device of the apparatus of FIG. 1, with the expanded position of the top opening device being shown in phantom.
Figure 9:
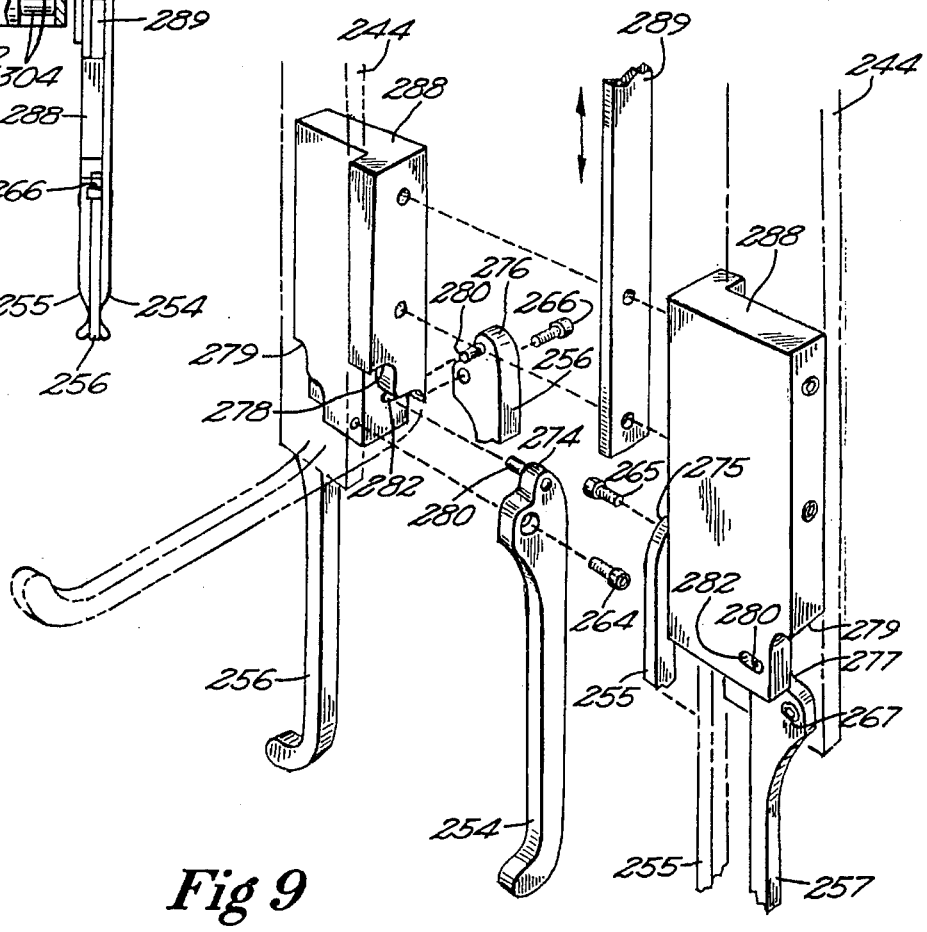
FIG. 9 shows a partial, exploded, perspective view of the top opening device of FIG. 8.

Apparatus 200 of the present invention is designed to transform cartons 12 to an open ended erected tubular state shown in FIGS. 4 and 5 for loading and then closing the open end thereof for storage and transport as shown in FIGS. 6 and 7. Apparatus 200 may take various forms but the illustrated embodiment includes an L-shaped horizontal carrier 202 generally having a horizontal leg 204 and a vertical leg 206 extending from the outer end of leg 204. Carrier 202 is mounted for movement in a direction parallel to leg 204 between a first position shown in FIGS. 1, 2, 5, 6, and 7 for receiving carton 12 and a second position shown in FIGS. 3 and 4 which is horizontally offset from the first position such as by suitable linear slide bearings reciprocally received on stationary shafts 210 suitably attached to the frame of apparatus 200 as shown. Carrier 202 can be moved between the first and second positions by any suitable means such as a crank arm, not shown.

Apparatus 200 further includes a carton elevator 212 having a generally C-shaped configuration. Specifically, elevator 212 generally includes first and second legs 214 and 216 which are arranged parallel to the movement direction of carrier 202 and spaced to allow receipt of leg 204 therebetween and to abut with the lower edges of panels 14 and 16 hingedly connected to flaps 22 and 23. Elevator 212 further includes an interconnecting leg 218 extending between and interconnecting the outer ends of legs 214 and 216. In the most preferred form, leg 218 is concave shaped between the upper surfaces of legs 214 and 216. Elevator 212 is mounted for movement between a lower position shown in FIGS. 1–3 and 7 and an upper position shown in FIGS. 4–6 such as by a linear extension 220 to leg 216 having suitable linear slide bearings reciprocally received on stationary shafts 224 suitably attached to the frame of apparatus 200 as shown. Elevator 212 can be moved between the lower and upper positions by any suitable means such as an air cylinder, not shown.

Apparatus 200 further includes a carton carriage 226 having a generally C-shaped configuration. Specifically, carriage 226 includes first and second parallel, side plates 228 and 230 which are spaced generally equal to but slightly larger than the width of panels 18 and 20. Carriage 226 further includes an end plate 232 which in the most preferred form is an access door extending between the outer ends of side plates 228 and 230 for abutment with panel 18 in the most preferred form.

Carriage 226 is mounted for movement between a first position shown in FIGS. 1–4, 6, and 7 for receipt of carton 12 from carrier 202 and a second, loading position shown in FIG. 5 which is horizontally offset from the first position generally perpendicular to the movement directions of carrier 202 and elevator 212 such as by linear slide bearings reciprocally received on stationary shafts 236 suitably attached to the frame of apparatus 200 as shown. Carriage 226 can be moved between the first and second positions by any suitable means such as a crank arm, not shown.

Carriage 226 further includes a suction cup 56 secured to pivot arm 253 for attachment adjacent to the outer corner of flap 22 opposite to flap 25 when flap 22 is linear with panel 14. Similarly, a suction cup 171 is secured to pivot arm 260 for attachment adjacent to the outer corner of flap 23 opposite to flap 24 when flap 23 is linear with panel 16. Likewise, a suction cup 172 is movable with pivot arm 284 for attachment adjacent to the outer corner of flap 24 opposite to flap 22 when flap 24 is linear with panel 18. Additionally, a suction cup 173 is secured to pivot arm 286 for attachment adjacent to the outer corner of flap 25 opposite to flap 23 when flap 25 is linear with panel 20. Suction cups 56 and 171–173 are positioned in the preferred form approximately 40% of the width of flaps 22–25 from their free edges and draw the outer corners of flaps 22–25 slightly outward of their planar condition with panels 14, 16, 18, and 20. In the most preferred form, suction cups 56 and 171–173 are of the collapsible type, and specifically, will collapse to draw flaps 22–25 towards pivot arms 253, 260, 284, and 286 when flaps 22–25 seal therewith due to vacuum forces. Pivot arms 253, 260, 284, and 286 are pivotally mounted to the upper edges of carriage 226 and are pivotable between an inner position shown in FIGS. 4 and 5 and an outer position shown in FIGS. 1–3 and 7 by any suitable means such as a cam mechanism, not shown.

Apparatus 200 further includes a stationary carton bottom support plate 240 suitably attached to the frame of apparatus 200. Plate 240 is positioned at a vertical height above leg 204 of carrier 202 and corresponding to the upper position of elevator 212 and horizontally offset from elevator 212 in the movement direction of carriage 226. Carriage 226 is positioned vertically above elevator 212 in the first position and is positioned vertically above support plate 240 in the second position.

In the most preferred form, apparatus 200 includes a device 120 for fan folding flaps 22–25 of the type as described in U.S. Pat. No. 5,352,178 and International Publication No. WO 94/17989, which are hereby incorporated herein by reference, so that tape is not required to seal the top of carton 12. Particularly, in a preferred form, device 120 generally includes a carriage 122 which is slideably mounted by suitable linear bearings on slide shafts 124. Carriage 122 is reciprocated between lower and upper positions by any suitable means such as a crank arm, not shown. Carriage 122 rotatably mounts first, second, third, and fourth tubes 130, 131, 132 and 133 about vertical, parallel axes. The free ends of tubes 130, 131, 132, and 133 include folding arms 140, 141, 142, and 143, respectively, extending generally perpendicular to tubes 130–133 and their axes of rotation. Tube 130 is positioned outside and parallel to panel 14 and the hinge connections of panel 14 to panels 18 and 20. Tube 130 is spaced from the hinge connection between panels 14 and 20 slightly more than the width of flap 25. Tube 131 is positioned outside and parallel to panel 16 and the hinge connections of panel 16 to panels 18 and 20. Tube 131 is spaced from the hinge connection between panels 16 and 18 slightly more than the width of flap 24. Tube 132 is positioned outside and parallel to panel 18 and the hinge connections of panel 18 to panels 14 and 16. Tube 132 is spaced from the hinge connection between panels 14 and 18 slightly more than the width of flap 22. Tube 133 is positioned outside and parallel to panel 20 and the hinge connections of panel 20 to panels 14 and 16. Tube 133 is spaced from the hinge connection between panels 16 and 20 slightly more than the width of flap 23. Suitable provisions, not shown, are provided for simultaneously pivoting tubes 130–133 and thus folding arms 140–143.

Apparatus 200 further includes a top opening device 242 for pivoting flaps 22–25 to be linear with panels 14, 16, 18, and 20. Device 242 includes first and second plates 244 which are secured to a holder 251 in a spaced, parallel relation parallel to panels 14 and 16 but horizontally offset from each other. Holder 251 is slideably mounted by suitable linear bearings on vertical slide shafts 252 suitably attached to the frame of apparatus 200 as shown. Holder 251 and plates 244 secured thereto are reciprocal between an upper position shown in FIGS. 1, 2, and 5–8 and a lower position shown in FIGS. 3 and 4 in the most preferred form by a crank arm 246 having a first end connected to a rotatable shaft 248 and a second end pivotally connected to an end of a turnbuckle 250. The opposite end of turnbuckle 250 is in turn pivotally mounted to holder 251 to which plates 244 are mounted. By rotating shaft 248 by any suitable means, not shown, holder 251 and plates 244 secured thereto can be reciprocated between the upper and lower positions. In the most preferred form, plates 244 extend through an aperture formed in carriage 122 intermediate the axes of tubes 130–133.

Device 242 further includes four fingers 254, 255, 256, and 257 pivotally mounted to plates 244 about axes 264, 265, 266, and 267, respectively. Specifically, axes 264 and 265 are defined by bolts which are threaded into the inner edges of plates 244 parallel to panels 14 and 16 and flaps 22 and 23, with fingers 254 and 255 being pivotable about axes 264 and 265 to abut with flaps 22 and 23, respectively. Axes 266 and 267 are defined by bolts which are threaded into the faces of plates 244 adjacent to their outer edges parallel to panels 18 and 20 and flaps 24 and 25, with fingers 256 and 257 being pivotable about axes 266 and 267 to abut with flaps 24 and 25, respectively.

Fingers 254–257 are pivotable between an insertion position shown in FIGS. 1–3 and 5–8 and an expanded position shown in FIG. 4. In the insertion position, fingers 254–257 are generally parallel and extend from axes 264–267 in generally the same direction. In the expanded position, fingers 254–257 are pivoted generally perpendicular to the insertion position and extend from axes 264–267 in different directions and in a generally planar condition. Specifically, in the most preferred form, fingers 254–257 each include a cam 274, 275, 276, and 277 vertically above and horizontally offset from axes 264–267, respectively. Further provided are first and second blocks 288 which are secured on opposite sides of a vertical plate 289 and positioned and reciprocally received between plates 244, with the combined width of blocks 288 and plate 289 being generally equal to and coextensive with the outer edges of plates 244. First and second blocks 288 each include a cam track 278 formed in their abutting edges corresponding to cams 274 and 275, respectively, and a cam track 279 formed in their opposite faces corresponding to cams 276 and 277, respectively. Cams 274–277 further include a pin 280 extending parallel to their axes 264–267 for slideable receipt in horizontally elongated bores 282.

Blocks 288 are reciprocated relative to plates 244 between an upper position as shown in FIGS. 1–3 and 5–7 and a lower position as shown in FIG. 4 by a crank arm 290 having a first end connected to a shaft 292 rotatable in holder 251 and a second end pivotally connected to an end of a turnbuckle 294. The opposite end of turnbuckle 294 is in turn pivotally mounted to plate 289. By rotating shaft 292, blocks 288 can be reciprocated between the upper and lower positions relative to plate 244. When blocks 288 are reciprocated from their upper position to their lower position, cam tracks 278 and 279 engage with cams 274–277 causing fingers 254–257 to rotate about their axes 264–267 from their insertion position to their expanded position when blocks 288 are reciprocated from their lower position to their upper position, fingers 254–257 will rotate about their axes 264–267 from their expanded position under the force of gravity as allowed by the abutment of cams 274–277 with cam tracks 278 and 279. Pins 280 abutting with the ends of bores 282 move and hold fingers 254–257 into their insertion position after the force of gravity no longer acts to move fingers 254–257 into their insertion position. It can then be appreciated that the major wear forces are between cams 274–277 and cam tracks 278 and 279 so that excessive wear of bores 282 does not occur.

In the most preferred form, shaft 292 is rotated by a crank arm 296 having a first end connected to shaft 292 and a second end having a cam follower 298. Cam follower 298 is received in a vertical cam track 300 carried by a carriage 302 which is slideably mounted by suitable linear bearings on slide shafts 304. Carriage 302 is reciprocated by a crank arm 306 having a first end connected to a rotatable shaft 308 and a second end pivotally connected to an end of a turnbuckle 310. The opposite end of turnbuckle 310 is in turn pivotally mounted to cam track 300. By rotating shaft 308 by any suitable means such as by a further crank arm, carriage 302 can be reciprocated between the inner and outer positions. When carriage 302 and cam track 300 move between the inner and outer positions, shaft 292 is rotated due to the positioning of cam follower 298 within cam track 300. Rotation of shaft 292 in turn reciprocates blocks 288 relative to plates 244 to thus pivot fingers 254–257 relative to plates 244. It should be noted that vertical cam track 300 allows plates 244 and fingers 254–257 to be reciprocated between the upper and lower positions without pivotable movement of fingers 254–257 relative to plates 244.

Figure 2:
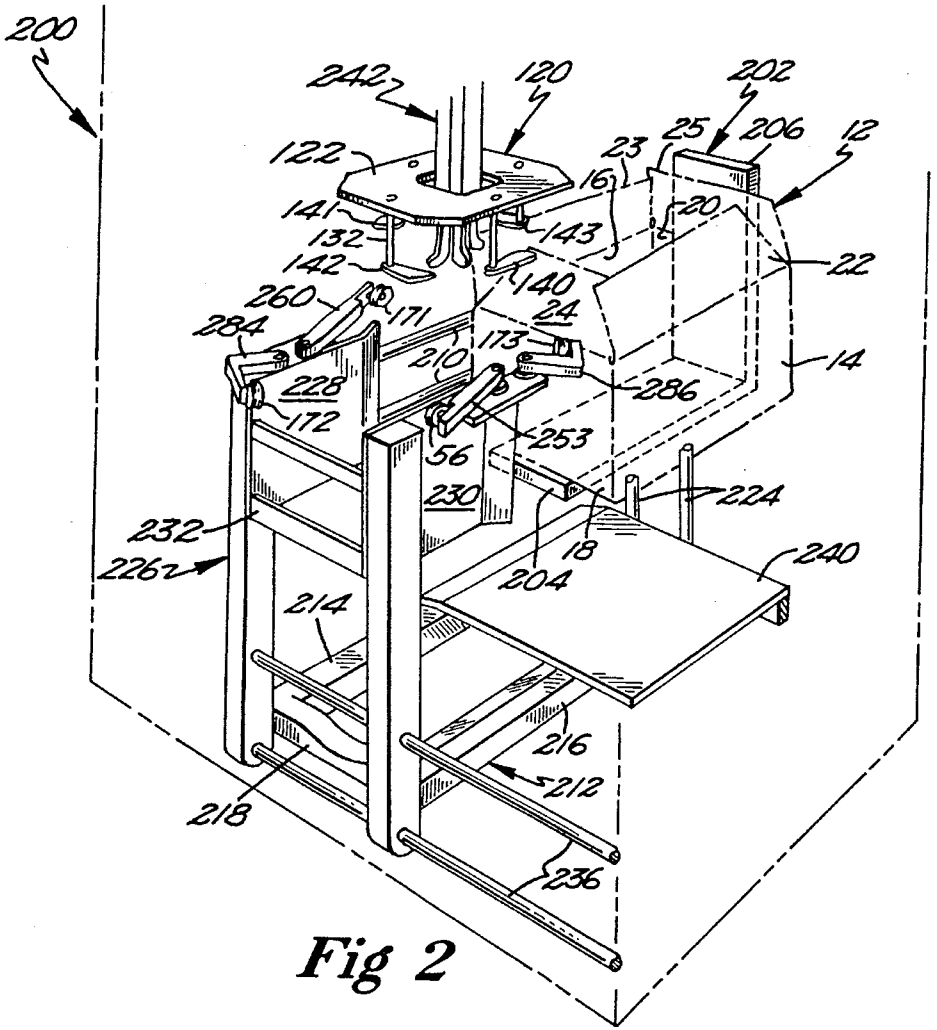

Now that the basic construction of apparatus 200 according to the preferred teachings of the present invention has been explained, the operation and subtle features of apparatus 200 can be set forth and appreciated. For the sake of explanation, it will be assumed that apparatus 200 is in the position shown in FIGS. 1 and 2 with carrier 202 in the first position, elevator 212 in the lower position, pivot arms 253, 260, 284, and 286 pivoted to their outer positions, carriage 226 in the first position, carriage 122 in the upper position, plate 244 and fingers 254–257 in the upper position, and fingers 254–257 in their insertion position. Carton 12 is initially positioned with the closed bottom and/or bottom edges of panels 18 and 20 abutting and being supported upon leg 204 with panel 20 positioned in front of leg 206 as shown in FIG. 2. In the most preferred form, carton 12 is vertically dropped upon carrier 202 but other manners of positioning carton 12 can be utilized according to the teachings of the present invention.

After positioning of carton 12 thereon, carrier 202 is moved from the first position shown in FIG. 2 to the second position shown in FIG. 3 to carry carton 12 to carriage 226. In the second position as shown in FIG. 3, panel 18 abuts with end plate 232 of carriage 226 and panel 20 abuts with leg 206 of carrier 202, with carton 12 being sandwiched between and under slight compression forces between end plate 232 and leg 206 parallel to the movement direction of carrier 202 in the preferred form.

It can then be appreciated that when cartons 12 are being utilized for the first time, flaps 22–25 typically will extend linearly from panels 14, 16, 18, and 20. However, after flaps 22–25 have been folded about their hinged connections to panels 14, 16, 18, and 20 and especially after multiple uses of cartons 12, flaps 22–25 will typically extend in a nonlinear angle towards the interior of the tubular body defined by panels 14, 16, 18, and 20. It can then be appreciated that the order of flaps 22–25 can vary and the nonlinear angle can also vary from an acute angle in the order of 45° or less to obtuse angles up to 180° from carton 12 to carton 12 depending upon various factors including but not limited to the number of times carton 12 has been previously utilized and the rigidity of flaps 22–25.

While carton 12 is sandwiched between plate 232 and leg 206, plate 244 and fingers 254–257 are moved from their upper position to their lower position as shown in FIG. 3. It can then be appreciated that fingers 254–257 in their insertion position are able to be inserted into the body defined by panels 14, 16, 18, and 20 independent of the position of flaps 22–25 and specifically into and through opening 27 of the top of carton 12. In the lower position, the free ends of fingers 254–257 are adjacent the bottom of carton 12 and in particular below the free edges of flaps 22–25.

After reaching their lower position, fingers 254–257 are pivoted from their insertion position to their expanded position as shown in FIG. 4. It can then be appreciated that as fingers 254–257 pivot outwardly, fingers 254–257 abut with and pivot any flaps 22–25 which are not at a linear angle with panels 14, 16, 18, and 20. It should be noted that since carton 12 is under compression forces between end plate 232 and leg 206, carton 12 will not have a tendency to raise in apparatus 200 due to the abutment of fingers 254–257 with flaps 22–25, but rather the abutment of fingers 254–257 with flaps 22–25 will cause flaps 22–25 to pivot relative to panels 14, 16, 18, and 20.

While fingers 254–257 are moving from their insertion position to their expanded position, elevator 212 is raised from its lowered position to its upper position as shown in FIG. 4. In the upper position, the bottom of carton 12 is supported by legs 214 and 216, is vertically above leg 204 of apparatus 200, and at the same vertical level as support plate 240. Specifically, as elevator 212 moves toward its upper position in a direction generally perpendicular to the compression forces placed upon carton 12 by end plate 232 and leg 206 in the preferred form, legs 214 and 216 engage the bottom of carton 12 and raise it above leg 204 of apparatus 200 while carton 12 is still under compression between end plate 232 and leg 206. It can be appreciated that leg 204 of carrier 202 passes between legs 214 and 216 of elevator 212 when elevator 212 moves from its lower position to its upper position.

It should then be appreciated that for cartons 12 which have not been previously utilized, flaps 22–25 of the bottom of carton 12 have a tendency to attempt to return to a linear condition with panels 14, 16, 18, and 20 due to the memory in the material forming carton 12 and thus the bottom of carton 12 tends to have a pyramid shape outward of the bottom edges of panels 14, 16, 18, and 20. On the other hand for cartons 12 which have been utilized multiple times, flaps 22–25 have been folded a number of times and have lost their tendency to return to a linear condition and will tend to be flat across the bottom edges of panels 14, 16, 18, and 20 and in fact may tend to cave inward if supported in the exact center of the bottom of carton 12. For many of the handling procedures down line such as the loading procedure, carton 12 must be held in the same position by carriage 226. It can then be appreciated that leg 204 supports the bottom of carton 12 in the longitudinal center with the height of carton 12 in carriage 226 varying depending upon the condition of flaps 22–25 forming the bottom of carton 12. Since elevator 212 raises carton 12 while compressed between end plate 232 and leg 206, any flaps 22–25 which are not perpendicular to panels 14, 16, 18, and 20 will tend to pivot to a perpendicular condition before carton 12 will slide between end plate 232 and leg 206. Additionally, as legs 214 and 216 support carton 12 along the bottom edges of panels 14 and 16 which typically will have a constant height even after carton 12 has been utilized a number of times, carton 12 will be at the same position in carriage 226 independent of the times carton 12 has been previously utilized. It should also be appreciated that since the lower edge of panel 20 is not supported due to the C-shaped configuration of legs 214, 216, and 218, the concave shape of leg 218 also does not support the lower edge of panel 18 to prevent carton 12 from canting.

Elevator 212 reaches its upper position generally simultaneously as fingers 254–257 are in their expanded position. In their expanded position, fingers 254–257 position flaps 22–25 in a generally linear condition to panels 14, 16, 18, and 20. At that time, pivot arms 253, 260, 284, and 286 are pivoted from their outer positions to their inner positions as shown in FIG. 4 to engage suction cups 56 and 171–173 with flaps 22–25. When secured to flaps 22–25, suction cups 56 and 171–173 will collapse to pull at least portions of flaps 22–25 slightly outward beyond the planar condition. Carton 12 is then held and under the control of suction cups 56 and 171–173 in carriage 226. After attachment of suction cups 56 and 171–173, plate 244 and fingers 254–257 can be raised from their lower position to their upper position and fingers 254–257 can be pivoted from their expanded position to their insertion position and carrier 202 can move from its second position to its first position as shown in FIG. 5.

After carrier 202 is spaced from carton 12 and fingers 254–257 have cleared flaps 22–25, carriage 226 can move from its first position to its second position as shown in FIG. 5 with movement of carriage 226 causing the bottom of carton 12 to slide from elevator 212 onto plate 240. While in the second position of carriage 226, carton 12 is presented for loading with product either mechanically or manually, with top flaps 22–25 being held in a generally planar condition to panels 14, 16, 18, and 20 by suction cups 56 and 171–173. After loading, carriage 226 can move from its second position back to its first position as shown in FIG. 6, with movement of carriage 226 causing the bottom of carton 12 to slide from plate 240 back onto elevator 212.

After the loaded carton 12 is positioned back on elevator 212 and while still under the control of suction cups 56 and 171–173 in carriage 226, carriage 122 is moved from its upper position towards its lower position as shown in FIG. 6. While carriage 122 is moving towards its lower position, flaps 22–25 can then be fan folded by folding arms 140–143 in a similar manner as described in U.S. Pat. No. 5,352,178 and International Publication No. WO 94/17989. It can be appreciated that vacuum to suction cups 56 and 171–173 is released as flaps 22–25 are folded by folding arms 140–143. After release of vacuum to suction cups 56 and 171–173, pivot arms 253, 260, 284, and 286 can be pivoted from their inner positions to their outer positions.

After the top of carton 12 has been closed, elevator 212 can be lowered from its upper position to its lower position as shown in FIG. 7. After elevator 212 reaches its lower position, closed carton 12 can be removed from elevator 212 by any suitable means such as a plunger diagramatically shown as an arrow in FIG. 7 which pushes carton 12 therefrom.

Now that the basic teachings of the present invention have been explained, many extensions and variations will be obvious to one having ordinary skill in the art. For example, although apparatus 200 according to the preferred teachings of the present invention is believed to be advantageous at least in the area of the maximation of the use of floor space, and specifically in that carton 12 is opened by fingers 254–257, fan folded by device 120, and removed from carriage 226 at the same location, such handling operations could be performed at separate locations such as with multiple carriages 226 traveling along a circuitous path.

Likewise, although apparatus 200 according to the preferred teachings of the present invention includes multiple, unique features and is believed to produce synergistic results, such features could be utilized singly or in other combinations according to the teachings of the present invention. For example, although the top of carton 12 is fan folded by device 120 in the most preferred form, the top of carton 12 can be closed by other manners and/or devices including but not limited to the use of tape to hold the top closed.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Apparatus for handling tubular cartons having panels defining a tubular body, with the panels having bottom edges, comprising, in combination: a carrier for carrying the carton; a carriage for holding the carton; means for moving the carrier from a first position spaced from the carriage for receiving the carton to a second position for placing the carton in the carriage with the carton being sandwiched between the carriage and the carrier for placing the carton under compression forces; and an elevator movable in a direction perpendicular to the compression forces from a first position to a second position, with the elevator sliding the carton between the carriage and the carrier when moving to the second position of the elevator while the carrier is in the second position.

2. The apparatus of claim 1 wherein the carrier is L-shaped and has a first leg for abutment with the bottom edges of the panels and a second leg for abutment with one of the panels of the carton, with the carrier moving in a direction parallel to the first leg and the compression forces; and wherein the elevator includes first and second, spaced legs, with the first leg of the L-shaped carrier passing between the legs of the elevator when the elevator moves from the first position to the second position.

3. The apparatus of claim 1 further comprising, in combination: suction cups for attachment to the carton, with the suction cups being secured to the carriage; and means for moving the carriage between first and second positions in a direction generally perpendicular to the movement direction of the carrier and the elevator.

4. The apparatus of claim 1 wherein the panels of the carton include closure flaps having free edges, with the free edges of the closure flaps in a closed condition defining an opening; and wherein the apparatus further comprises, in combination: a device for opening the closure flaps comprising, in combination: a finger corresponding to each of the closure flaps; means for moving the fingers between an insertion position and an expanded position, with the fingers in the insertion position adapted for passage through the opening and the fingers in the expanded position adapted to abut with the closure flaps not at a linear angle with the panels; and means for moving the fingers relative to the carriage in a direction parallel to the movement direction of the elevator for inserting the fingers while in the insertion position into the tubular carton, with the fingers being movable to the expanded position after insertion into the tubular carton for abutting with and pivoting the closure flaps relative to the panels.

5. The apparatus of claim 4 wherein the means for moving the fingers between the insertion and expanded position comprise, in combination: a plate; means for pivotally mounting each of the fingers to the plate; and means for pivoting the fingers relative to the plate.

6. The apparatus of claim 5 wherein the pivoting means comprises, in combination: a cam follower formed on each of the fingers; and a cam track for each of the cam followers reciprocally mounted on the plate; and means for reciprocating the cam tracks relative to the plate.

7. The apparatus of claim 1 wherein the carton includes first, second, third, and fourth panels connected together about hinge connections, with the second and fourth panels being spaced and located intermediate the first and third side panels, with the carton including first and second major closure flaps connected to the first and third panels and first and second minor closure flaps connected to the second and fourth panels, with the closure flaps extending generally linearly to the first, second, third, and fourth panels in the carriage, with the closure flaps each including first and second outside corners; and wherein the apparatus further comprises, in combination: means for pushing the first corner of the first major closure flap simultaneously inward and forward and prior to the second corner of the first minor closure flap, for pushing the first corner of the first minor closure flap simultaneously inward and forward and prior to the second corner of the second major closure flap, for pushing the first corner of the second major closure flap simultaneously inward and forward and prior to the second corner of the second minor closure flap, and for pushing the first corner of the second minor closure flap simultaneously inward and forward and prior to the second corner of the first major closure flap, with the first corners of the first and second major closure flaps and of the first and second minor flaps being pushed simultaneously until extending generally perpendicularly to the panels of the carton and forming the bottom of the carton.

8. The apparatus of claim 7 further comprising, in combination: first means for holding the second corner of the first major flap when the closure flaps are initially pushed to insure that the first corner of the second minor closure flap is positioned forward of the second corner of the first major closure flap when the closure flaps extend generally perpendicular to the side panels; second means for holding the second corner of the first minor flap when the closure flaps are initially pushed to insure that the first corner of the first major closure flap is positioned forward of the second corner of the first minor closure flap when the closure flaps extend generally perpendicular to the side panels; third means for holding the second corner of the second major flap when the closure flaps are initially pushed to insure that the first corner of the first minor closure flap is positioned forward of the second corner of the second major closure flap when the closure flaps extend generally perpendicular to the side panels; and fourth means for holding the second corner of the second minor flap when the closure flaps are initially pushed to insure that the first corner of the second minor closure flap is positioned forward of the second corner of the second major closure flap when the closure flaps extend generally perpendicular to the side panels.

9. The apparatus of claim 1 wherein the carton is removed from the carriage as the elevator moves from the second position to the first position and while the carrier is spaced from the second position.

10. Method for uniformly positioning cartons in a carriage, with the cartons each including panels defining a tubular body and having bottom edges, comprising the steps of: moving the carton from a position spaced from the carriage for placing the carton in the carriage and for placing the carton under compression forces within the carriage; and pushing the carton by the bottom edges of the panels in a direction perpendicular to the compression forces and while the carton is under compression forces.

11. Device for opening multiple closure flaps of a tubular carton, with the closure flaps having free edges, with the free edges of the closure flaps in a closed condition defining an opening, comprising, in combination: a finger corresponding to each of the closure flaps; means for moving the fingers between an insertion position and an expanded position, with the fingers in the insertion position adapted for passage through the opening and the fingers in the expanded position adapted to abut with the closure flaps not at a linear angle with the tubular carton; and means for moving the fingers relative to the tubular carton for inserting the fingers while in the insertion position into the tubular carton, with the fingers being movable to the expanded position after insertion into the tubular carton for abutting with and pivoting the closure flaps relative to the tubular carton.

12. The device of claim 11 wherein the means for moving the fingers between the insertion and expanded positions comprise, in combination: a plate; means for pivotally mounting each of the fingers to the plate; and means for pivoting the fingers relative to the plate.

13. The device of claim 12 wherein the pivoting means comprises, in combination: a cam follower formed on each of the fingers; and a cam track for each of the cam followers reciprocally mounted on the plate; and means for reciprocating the cam tracks relative to the plate.

14. The device of claim 13 wherein the means for moving the fingers relative to the tubular carton comprises means for reciprocating the plate relative to the carton; and wherein the means for reciprocating the cam tracks relative to the plate comprises, in combination: a shaft rotatable about an axis fixed relative to the plate; means for transferring rotation of the shaft into reciprocation of the cam tracks; a crank arm having a first end rotatably fixed to the shaft and a second end including a cam follower; a cam track for receipt of the cam follower and arranged parallel to the direction of reciprocation of the plate; and means for moving the cam track perpendicular to the direction of reciprocation of the plate.

15. The device of claim 13 wherein the pivoting means further comprises, in combination: a pin secured to each of the fingers; and an elongated bore formed with each of the cam tracks for slideable receipt of the pin.

16. The apparatus of claim 11 wherein the tubular carton includes panels defining a tubular body, with the panels having bottom edges; wherein the apparatus further comprises, in combination: a carrier for carrying the carton; a carriage for holding the carton; means for moving the carrier from a first position spaced from the carriage for receiving the carton to a second position for placing the carton in the carriage with the carton being sandwiched between the carriage and the carrier for placing the carton under compression forces; and an elevator movable in a direction perpendicular to the compression forces from a first position to a second position, with the elevator sliding the carton between the carriage and the carrier when moving to the second position of the elevator while the carrier is in the second position.

17. The apparatus of claim 16 wherein the carrier is L-shaped and has a first leg for abutment with the bottom edges of the panels and a second leg for abutment with one of the panels of the carton, with the carrier moving in a direction parallel to the first leg and the compression forces; and wherein the elevator includes first and second, spaced legs, with the first leg of the L-shaped carrier passing between the legs of the elevator when the elevator moves from the first position to the second position.

18. The apparatus of claim 16 further comprising, in combination: suction cups for attachment to the carton, with the suction cups being secured to the carriage; and means for moving the carriage between first and second positions in a direction generally perpendicular to the movement direction of the carrier and the elevator.

19. Method for opening multiple closure flaps of a tubular carton, with the closure flaps having free edges, with the free edges of the closure flaps in a closed condition defining an opening, comprising the steps of: moving fingers while in an insertion position through the opening, with the number of fingers corresponding to the number of closure flaps, with the fingers in the insertion position adapted for passage through the opening; and expanding the fingers from the insertion position to a size larger than the opening after the fingers are moved through the opening to pivot the closure flaps relative to the tubular carton.

20. Apparatus for handling tubular cartons having panels defining a tubular body, with the panels including bottom edges and closure flaps having free edges, with the free edges of the closure flaps in a closed condition defining an opening, comprising, in combination: a carrier for carrying the carton; a carriage for holding the carton; means for moving the carrier from a first position spaced from the carriage for receiving the carton to a second position for placing the carton in the carriage with the carton being sandwiched between the carriage and the carrier for placing the carton under compression forces; an elevator movable in a direction perpendicular to the compression forces from a first position to a second position, with the elevator sliding the carton between the carriage and the carrier when moving to the second position of the elevator while the carrier is in the second position; and a device for opening the closure flaps comprising, in combination: a finger corresponding to each of the closure flaps; means for moving the fingers between an insertion position and an expanded position, with the fingers in the insertion position adapted for passage through the opening and the fingers in the expanded position adapted to abut with the closure flaps not at a linear angle with the panels; and means for moving the fingers relative to the carriage in a direction parallel to the movement direction of the elevator for inserting the fingers while in the insertion position into the tubular carton, with the fingers being movable to the expanded position after insertion into the tubular carton for abutting with and pivoting the closure flaps relative to the panels.

21. Method for uniformly positioning cartons in a carriage, with the cartons each including panels defining a tubular body and having bottom edges, comprising the steps of: placing the carton in the carriage and placing the carton under compression forces within the carriage; pushing the carton by the bottom edges of the panels in a direction perpendicular to the compression forces and while the carton is under compression forces; attaching suction cups to the carton, with the suction cups being secured to the carriage; and removing the compression of the carton within the carriage after the suction cups are attached to the carton.

22. Method for uniformly positioning cartons in a carriage, with the cartons each including panels defining a tubular body and having bottom edges, comprising the steps of: placing the carton in the carriage and placing the carton under compression forces within the carriage; pushing the carton by the bottom edges of the panels in a direction perpendicular to the compression forces and while the carton is under compression forces; wherein the placing step comprises the steps of providing an L-shaped carrier having a first leg for abutment with the bottom edges of the panels and a second leg for abutment with one of the panels of the carton; and moving the L-shaped carrier with the carton supported thereon into the carriage, with the carton being sandwiched between the carriage and the second leg.

23. The method of claim 22 wherein the pushing step comprises the step of moving an elevator from a first position spaced from the bottom edges to a second position abutting and pushing the bottom edges, with the elevator including first and second, spaced legs, with the first leg of the L-shaped carrier passing between the legs of the elevator when the elevator moves from the first position to the second position.

24. The method of claim 23 wherein the L-shaped carrier moves in a direction perpendicular to the direction that the elevator moves.

* * * * *